United States Patent [19]

Wortman

[11] 4,033,573

[45] July 5, 1977

[54] APPARATUS FOR CONVEYING MATERIAL AT A CONSTANT RATE TO A VARIABLE LOCATION

[76] Inventor: Harold Wortman, 5936 Monroe St., Morton Grove, Ill. 60053

[22] Filed: Sept. 29, 1975

[21] Appl. No.: 617,279

[52] U.S. Cl. ..... 270/30; 141/284; 226/188

[51] Int. Cl.[2] ..... B65H 29/46

[58] Field of Search ..... 270/30, 31; 141/284; 226/188; 56/114; 271/173, 273

[56] References Cited

UNITED STATES PATENTS 3,913,904 10/1975 Occhetti ..... 270/30

*Primary Examiner*—Houston S. Bell, Jr.
*Attorney, Agent, or Firm*—Dressler, Goldsmith, Clement, Gordon & Shore, Ltd.

[57] ABSTRACT

An apparatus is disclosed for receiving material supplied to it from a source at a constant rate and conveying it at a constant rate and tension to a variable location on a material receiving means. The apparatus includes a main frame, a carriage which is movable on the frame, and means for moving the carriage back and forth relative to the frame. An endless belt having a predetermined speed is supported on the frame and engages a material drive means that is supported for movement with the carriage and preferably includes a drive wheel which engages the belt and a roller which moves linearly with the carriage and supplies the material to a variable location on the material receiving means. By suitably arranging the drive wheel, roller and endless belt, as by providing a drive wheel and roller having the same diameter, the speed of linear travel of the carriage is automatically, either added to, or subtracted from the peripheral speed of the roller relative to the frame to thereby convey the material at a constant speed to a variable location while maintaining the material at a constant tension between the material supply means and the roller.

8 Claims, 3 Drawing Figures

APPARATUS FOR CONVEYING MATERIAL AT A CONSTANT RATE TO A VARIABLE LOCATION

BACKGROUND OF THE INVENTION

This invention relates to an apparatus for feeding materials. More particularly, this invention relates to an apparatus for conveying materials at a constant rate to a variable location and which can maintain the material at a constant tension.

It is frequently desirable to supply a material to a variable position or location. For example, a material such as cloth, paper, or film can be supplied to a variable location to effectively layer the material.

In the past, there has been a problem in developing an apparatus to supply material to a variable location on a material receiving means while maintaining a generally constant tension in the material while traveling through the apparatus. Where material such as cloth, paper, etc., travels from a material supply means through a nip formed between a pair of rollers, and the rollers move linearly relative to the material receiving means to supply the material to a variable location, the tension in the material between the material supply means and the rollers alternatively increases and decreases. This adversely affects the uniformity of the material in the finished product.

SUMMARY OF THE INVENTION

The present invention overcomes the problems of the prior art and provides an apparatus for conveying material at a constant rate while supplying the material to a variable location on a material receiving means. The apparatus is particularly useful for depositing materials into a plurality of superimposed layers. Where the materials is fed from a material supply means through a nip formed between a pair of rollers, the apparatus maintains the sheet at a constant tension between the material supply means and the rollers.

The apparatus deposits the material on a material receiving means and includes a main frame, a carriage which is movable on the frame, and means for moving the carriage back and forth relative to the frame in a plane having a component of motion that is generally parallel to the material receiving means. A material drive means is supported for movement with the carriage. To convey the material at a constant rate while the material drive means moves back and forth with the carriage, an endless driven belt having a predetermined speed is provided which is supported on the frame and engages the material drive means. The material drive means preferably includes a drive wheel which engages the belt.

In one embodiment of the invention, the material is a continuous sheet and the material drive means includes a pair of rollers forming a nip therebetween, which rollers receive the material from a material supply means. Alternatively, the material may comprise a web of fibers, or a particulate material, in which case the material is supplied along a conveyor rather than being drawn by a pair of rollers, and the conveyor is driven by a roller in engagement with the conveyor.

By suitably arranging the endless belt, drive wheel, and roller(s), as by providing a drive wheel having the same diameter as the roller which engages the material, or the roller which engages the conveyor (where the material is a web of fibers, or a particulate material), the speed of linear travel of the carriage is automatically, either added to, or substracted from the peripheral speed of the roller relative to the frame to thereby convey the material at a constant speed to a variable location. If the material is a sheet of material, such as, cloth, paper, or film, which is drawn by a pair of rollers defining a nip therebetween, the apparatus of the present invention simultaneously maintains the material at a constant tension between the material supply means and the rollers.

DETAILED DESCRIPTION OF THE PREFERRED EMBODIMENT

Figures 1, 2:
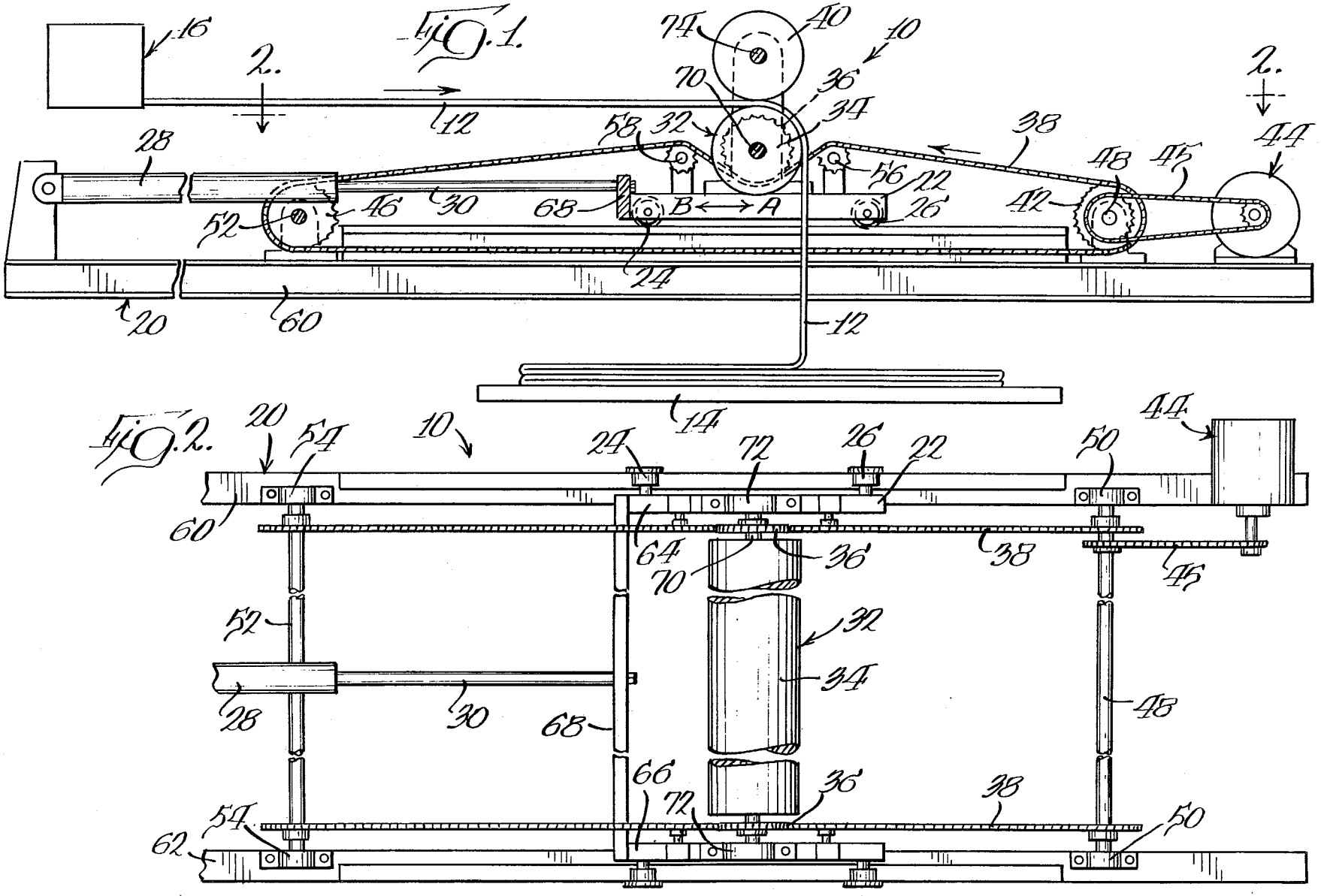
FIG. 1 is a front elevational view of the apparatus of the present invention.
FIG. 2 is a fragmentary view of the apparatus of FIG. 1 taken along plane 2—2.

While this invention is susceptible of embodiment of many different forms, there are shown in the drawings and will herein be described in detail several embodiments, with the understanding that the present disclosure is to be considered an exemplification of the principles of the invention and is not intended to limit the invention to the embodiments illustrated.

Referring to FIGS. 1 and 2, an apparatus 10 is shown for conveying material 12 at a constant rate while supplying the material to a variable location on a material receiving means 14. Material 12, such as, cloth, paper, film, etc., is fed from any suitable material supply means 16, which is a preferred embodiment is being fed at a constant speed.

Apparatus 10 includes a main frame 20, a carriage means, such as, carriage 22, having wheels 24, 26 that are movable on frame 20, and moving means, such as, cylinder 28, attached to frame 20. Piston rod 30 attached to carriage 22 is provided for moving carriage 22 back and forth relative to frame 20.

A material drive means 32 is supported for movement with carriage 20 to deposit material 12 in a predetermined pattern. The material drive means 32 illustrated comprises a roller 34 which engages material 12 and drive wheels 36 which are fixed for rotation with roller 34. Each drive wheel 36 engages an endless driven belt 38 which is supported on frame 20 and has a predetermined speed. Roller 34 engages one face of material 12, and the material drive means 32 also includes an upper roller 40 (FIG. 1) which engages an opposite face of material 12, rollers 34 and 40 forming a nip therebetween through which material 12 passes. As described in greater detail hereinbelow, the speed of linear travel of carriage 22 increases or decreases the peripheral speed of the material drive means 32 relative to frame 20 to convey material 12 at a constant rate while depositing the material at a variable location on the material receiving means 14. Additionally, where material 12 is a continuous sheet material, a generally constant tension is maintained in material 12 between the material supply means 16 and the nip for any position of the carriage 22.

Movement of carriage 22 and the material drive means 32 in the direction opposite to movement of material 12 or in the direction of movement of material 12 would normally increase or decrease the velocity of material 12 between material supply means 16 and material drive means 32 by an amount corresponding to the distance which the material drive means 32 is moved divided by the time in which the movement took place. According to the present invention, the speed of linear travel of carriage 22 is automatically either added to, or substracted from the peripheral speed of roller 34, thereby enabling material 12 to be conveyed at a uniform constant rate. This is accomplished when roller 34 and each drive wheel 36 are approximately the same diameter, whereby the circumference of roller 34 is approximately equal to the circumference of each drive wheel 36. Since material 12 is in engagement with roller 34, and each drive wheel 36 is in engagement with a driven belt 38, the amount of radial movement of roller 34 equals the distance of travel of carriage 22, thereby accelerating the peripheral speed of roller 34 when roller 34 moves in the direction of arrow A and decelerating roller 34 when carriage 22 moves in the direction of arrow B, and conveying material 12 at a constant rate.

As shown in FIGS. 1 and 2, each endless driven belt 38 may comprise a continuous chain belt driven by a drive sprocket 42 which is suitably connected to motor means 44, as by driven belt 45. The drive sprocket 42 and motor means 44 are mounted on frame 20. Idler sprockets 46 supported on frame 20 may also be provided, with each drive sprocket 42 preferably being positioned on one side of carriage 22 and each idler sprocket 46 being positioned on the opposite side of carriage 22. Each drive sprocket 42 rotates about a shaft 48 which is supported by bearings 50 in frame 20, and each idler sprocket 46 rotates about a shaft 52 which is supported by bearings 54 fixed in frame 20.

Preferably, each drive wheel 36 is a sprocket having a pitch diameter approximately equal to the diameter of roller 34. To facilitate in driving each sprocket 36, first and second idler rollers 56, 58 are suitably supported on carriage 22 and engage the corresponding belt 38. Idler rollers 56, 58 are positioned so that each sprocket 36 deflects the corresponding belt 38 between idler rollers 56, 58, thereby ensuring engagement of belts 38 by sprockets 36.

As best illustrated in FIG. 2, frame 20 preferably comprises two parallel spaced apart frame members 60, 62. Carriage 22 includes spaced apart members 64, 66 which are parallel to frame members 60, 62 and are connected by a transverse member 68 to which piston rod 30 is attached. Each carriage member 64, 66 has a pair of rollers 24, 26 suitably connected thereto, and frame members 60, 62 serve as a track for the rollers. Sprockets 36 and roller 34 are mounted on a shaft 70, as by a key (not shown), the shaft being supported for rotation by bearings 72 which are fixed to carriage members 64, 66. Roller 34 is centrally positioned on shaft 70 and sprockets 36 are positioned on opposite sides of roller 34 for engagement with belts 38. Similarly, upper roller 40 is mounted on shaft 74 which is supported for rotation by bearings (not shown) fixed to frame members 60, 62. Rollers 34, 40 engage the material 12 and draw the material from the material supply means 16. After passing through the nip formed between rollers 34, 40 the material 12 falls generally downwardly to the material receiving means 14.

It is a feature of the present invention that material from a material supply means can be supplied at a constant rate to a variable location on a stationary material receiving means 14. The apparatus of the present invention is particularly suitable where it is desirable to supply a web of material in a substantially layered or laminar manner having a constant or variable width, as desired. By utilizing the apparatus of the present invention, the position at which the web of material is deposited can be controlled by moving carriage 22 in the desired manner. For example, a layered web of material which is tapered at both ends can be formed on a material receiving means, such as, a conveyor, moving normal to the plane of the paper in FIG. 1 by initially depositing material 12 at a predetermined location, gradually increasing the distance that carriage 22 is moved back and forth to produce a tapered portion at one end of the layered web, repeatedly moving the carriage 22 back and forth a fixed distance to form the elongated central portion of the web, gradually decreasing the distance that carriage 22 is moved back and forth to produce a tapered portion at the opposite end of the web, and then cutting the material. This tapered web could be used to form a tapered pillow, if desired.

While the present invention has been described as supplying a material comprising a continuous sheet material to a variable location on a material receiving means, other materials may also be used with the apparatus.

Figure 3:
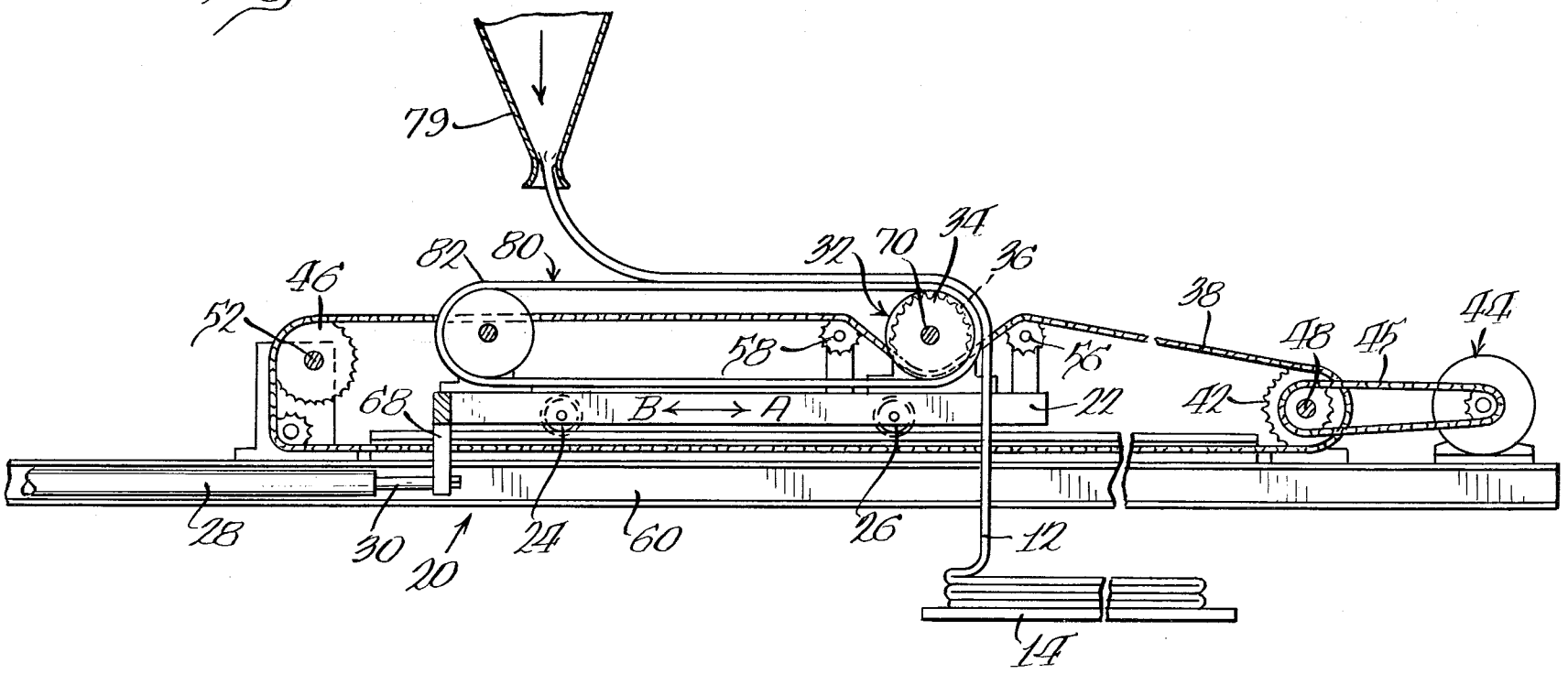
FIG. 3 is a front elevational view of another embodiment of apparatus incorporating the present invention.

For example, as shown in FIG. 3, material 12 received from material source 79 may comprise a web of fibers, formed by a web-forming means, as is disclosed in commonly assigned U.S. Pat. No. 3,878,873 to Willis et al., or a particulate material, such as, a mineral, or pulverulent material, or a liquid in which case the material is conveyed on a moving support or conveyor 80 which is interrelated with the material drive means 32, so that the exit end of the conveyor will be moved by carriage 22 to deposit the material 12 at a variable location on the material receiving means 14.

Specifically, the conveyor is a continuous belt 82 disposed around rollers 32, 84 which are mounted on axles 70, 86, respectively, mounted in support members secured to carriage 22. Belt 82 is driven by sprocket 34 and the exit end of belt 82 is positioned by movement of carriage 22, or controlled by cylinder 28 in the manner described with respect to FIGS. 1 and 2. All other parts of FIG. 3 that are similar to those illustrated in FIGS. 1 and 2 have been labeled with the same numbers.

Other variations and modifications are included as fall within the true spirit and scope of the invention.

What is claimed is:

1. Apparatus for conveying material at a constant rate while supplying the material to a variable location on a material receiving means comprising: a main frame; endless driven belt means which is supported on said frame and has a predetermined speed; a carriage means which is movable on said frame; means for moving said carriage means back and forth relative to said frame; a material supply means operating at a constant speed; and a material drive means engaging said belt means, and supported for movement with said carriage to supply said material to a variable location on said material receiving means, whereby the speed of linear travel of said carriage means increases or decreases the peripheral speed of said material drive means relative to said frame to convey said material at a constant rate while supplying the material to a variable location.

2. Apparatus as set forth in claim 1 in which the material drive means includes a conveyor assembly.

3. Apparatus as defined in claim 1 wherein said material drive means includes a roller which engages said material and a drive wheel which engages said belt means and is fixed for rotation with said roller.

4. Apparatus as defined in claim 3 wherein the circumference of said roller is approximately equal to the circumference of said drive wheel.

5. Apparatus as defined in claim 1 wherein said material drive means includes a lower roller which engages one face of said material, and an upper roller which engages an opposite face of said material, said rollers forming a nip therebetween, said material passing through said nip and having a generally constant tension between said material supply means and said nip for any position of said carriage.

6. Apparatus as defined in claim 1 wherein said means for moving said carriage comprises an air cylinder and piston rod having one end secured to said frame and an opposite end attached to said carriage means.

7. Apparatus for conveying material at a constant rate while supplying the material to a variable location on a material receiving means comprising: a main frame; endless driven belt means which is supported on said frame and has a predetermined speed; a carriage means which is movable on said frame; means for moving said carriage means back and forth relative to said frame; a material supply means; and a material drive means engaging said belt means, and supported for movement with said carriage to supply said material to a variable location on said material receiving means, said material drive means including a drive wheel which engages said belt means, a lower roller which engages one face of said material and is fixed for rotation with said drive wheel, the circumference of said lower roller being approximately equal to the circumference of said drive wheel, and an upper roller which engages an opposite face of said material, said rollers forming a nip therebetween, said material passing through said nip and having a generally constant tension between said material supply means and said nip for any position of said carriage, whereby the speed of linear travel of said carriage means increases or decreases the peripheral speed of said material drive means relative to said frame to convey said material at a constant rate while supplying the material to a variable location.

8. Apparatus as defined in claim 7 wherein said endless driven belt means comprises a continuous chain belt driven by a drive sprocket and engaging an idler sprocket, said sprockets being supported on said frame, and said drive wheel includes a sprocket engaging said chain.

* * * * *